US006253674B1

(12) United States Patent
Cook

(10) Patent No.: US 6,253,674 B1
(45) Date of Patent: Jul. 3, 2001

(54) VACUUM PRINTING APPARATUS AND PROCESS METHOD

(76) Inventor: Michael E. Cook, 104 Branch Cir., East Berlin, PA (US) 17316

( * ) Notice: Subject to any disclaimer, the term of this patent is extended or adjusted under 35 U.S.C. 154(b) by 0 days.

(21) Appl. No.: 09/440,478

(22) Filed: Nov. 15, 1999

(51) Int. Cl.[7] ..... B41F 15/20; B41L 13/02

(52) U.S. Cl. ..... 101/126; 101/129; 101/488; 118/301

(58) Field of Search ..... 101/114, 115, 101/126, 127, 127.1, 129, 487, 488, 490; 33/562, 563, 564, 565, 566; 118/300, 301; 273/309; 473/4; 8/445

(56) References Cited

U.S. PATENT DOCUMENTS

| | | | | |
|---|---|---|---|---|
| 1,143,222 | | 6/1915 | Nathan . | |
| 2,419,695 | * | 4/1947 | Shuttleworth et al. | 101/126 |
| 3,172,358 | * | 3/1965 | Weiss | 101/126 |
| 3,399,890 | | 9/1968 | Galedrige . | |
| 3,418,931 | * | 12/1968 | Wilford | 101/126 |
| 4,173,928 | * | 11/1979 | Mitter | 101/126 |
| 4,649,817 | | 3/1987 | Smith | 101/129 |
| 4,734,298 | * | 3/1988 | Kikukawa | 101/129 |

* cited by examiner

*Primary Examiner*—John S. Hilten
*Assistant Examiner*—Leslie J. Grohusky
(74) *Attorney, Agent, or Firm*—Samuel M. Learned, Jr

(57) ABSTRACT

A vacuum printing apparatus and process method whereby the application of a decorative imprint in either a single or multi-color rendition to the felt cover playing surface of a pool or billiard table is accomplished without there being any resultant dimensional or thickness irregularity in the playing surface which would otherwise interfere with the course of a ball during play.

19 Claims, 6 Drawing Sheets

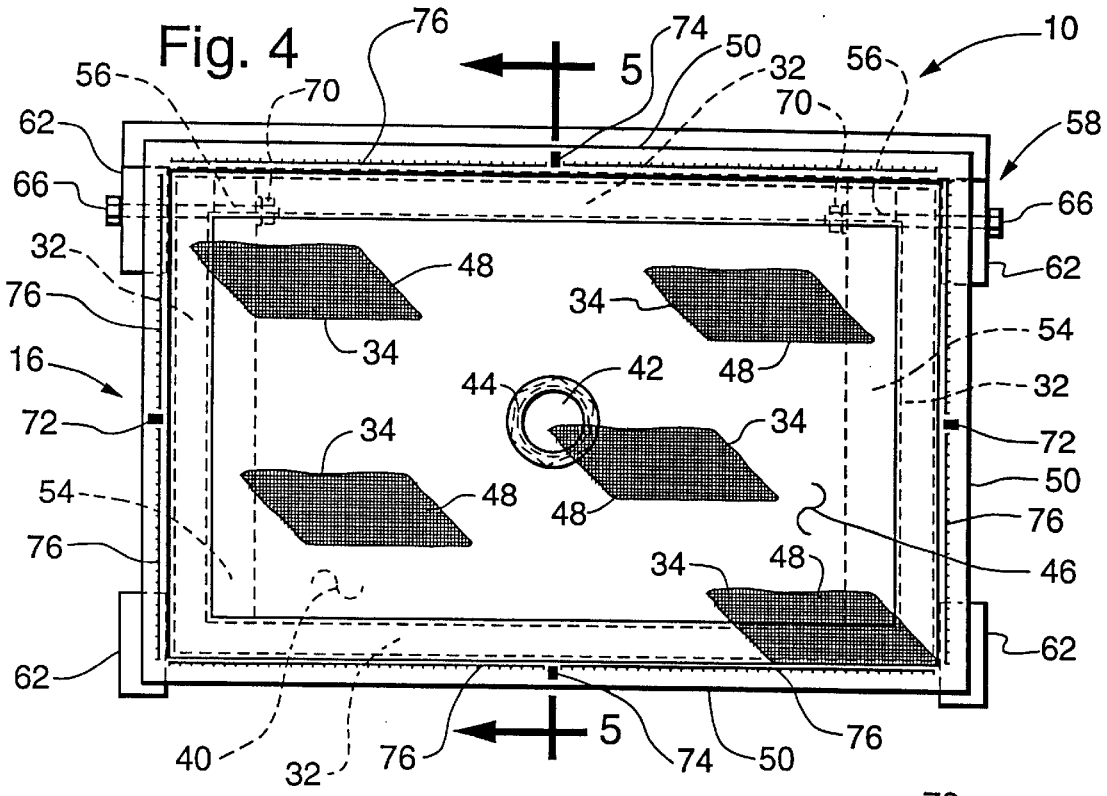
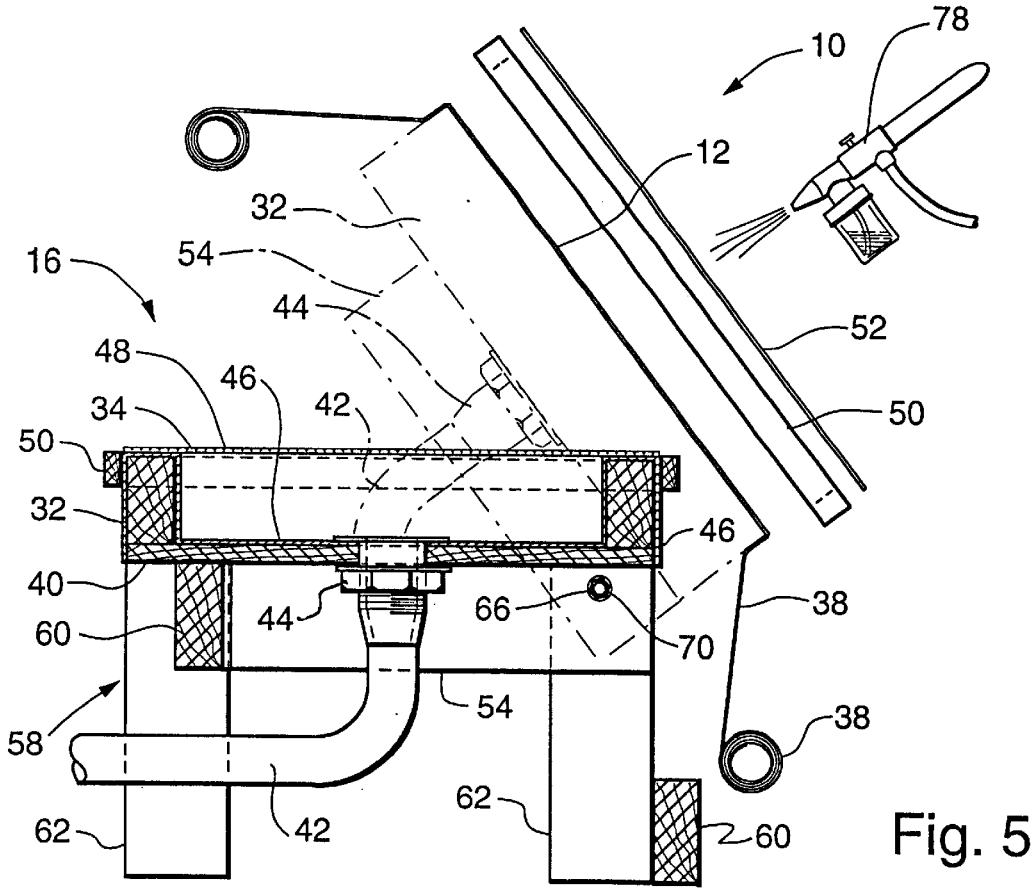
Fig. 5

VACUUM PRINTING APPARATUS AND PROCESS METHOD

BACKGROUND OF THE INVENTION

This invention relates to the apparatus and process method for application of decorative imprints in either single or multi-color renditions to the felt cover playing surface of either a pool or billiard table.

It is well known in pool and billiard table art that a primary requirement for pool and billiard table surfaces, if there is to be accurate play, is that such surfaces must be absolutely flat and true with no thickness or dimensional irregularities that would interfere with the course of either a cue or game ball during play. Thus, the application of any decorative imprint to the felt surface covering for a pool or billiard table top was not heretofore satisfactorily accomplished as an interfering playing surface irregularity was thereby incorporated and inherent to any such decorative application. Being illustrative of the foregoing point, as in the case of placement of a "spot" on either a pool or billiard table for spotting the cue ball, illustratively taught in Nathan, U.S. Pat. No. 1,143,222 dated Jun. 15, 1915, there is disclosed the use of a "—thin, tough material, as for instance linen or silk fabric,—over which the balls may roll with the least deflection." (emphasis added).

Another pool table teaching showing playing surface decorative imprints is as set forth in Galedrige, U.S. Pat. No. 3,399,890 dated Sep. 3, 1968, which teaches the use of novel markings upon a pool table playing surface, wherein, however, no method or procedure is described or disclosed regarding the nature or character of the marking medium or application thereof.

The imprinting methodology as herein taught employs the use of a vacuum frame apparatus to effect the drawing of the printing ink or paint through an imprint stencil and into the pool or billiard table felt covering fabric to thereby eliminate the adverse effects of the incorporation of thickness and dimensional irregularities. Although the vacuum frame apparatus for photostencil preparation as taught in Smith, U.S. Pat. No. 4,649,817 dated Mar. 17, 1987, is structurally similar, the methodology and functional aspects thereof are applied to the art of stencil preparation as opposed to stencil printing per se, and are thus clearly distinguished.

When the application of decorative imprints in either single or multi-color rendition to a pool or billiard table felt cover playing surface is desired, without the incorporation therein of either thickness or dimensional irregularities which would otherwise interfere with the course of either a cue or game ball during play, the instant invention provides a new and novel apparatus and process method for accomplishing the same.

SUMMARY OF THE INVENTION

It is the principal object of the present invention to provide a vacuum printing apparatus and process method for application of decorative imprints to the felt cover playing surface for a pool or billiard table.

Yet another important object of the present invention is to provide a vacuum printing process method whereby a decorative imprint may be applied to the felt cover playing surface of a pool or billiard table without incorporating a resultant dimensional or thickness irregularity in the playing surface which would in any way otherwise interfere with the course of a ball during play.

A further object of the present invention is to provide a vacuum printing process method which enables the application of decorative imprints in either a single or multi-color rendition upon the felt cover playing surface of a pool or billiard table.

A still further object of the present invention is to provide a vacuum printing apparatus and process method which enables the application of various customized decorative imprints to the felt cover playing surface for a pool or billiard table.

Another object of the present invention is to provide a vacuum printing apparatus and process method whereby the respective ink or paint medium layers comprising a multi-color decorative imprint, which are sequentially applied to the felt cover playing surface of a pool or billiard table, are respectively and successively impregnated to adhere within the felt material fabric structure.

Yet another object of the present invention is to provide a vacuum printing apparatus and process method which further enables the application of a decorative imprint to the playing surface of a pool or billiard table which will retain the applied color vibrance and distinctive shape outline when repeatedly subjected to the rigors of game play over an extended time.

Still another object of the present invention is to provide a vacuum printing apparatus and process method for application of a decorative imprint to the felt cover playing surface for a pool or billiard table which is accomplished with the use of relatively simple and inexpensive equipment, adapted to be utilized and employed in carrying out the process method by persons of ordinary skill without the need for extensive or prolonged training.

These and other objects, advantages and features of the invention will be readily evident upon a study of the following specification taken in conjunction with the accompanying drawings comprising a part thereof, in which:

BRIEF DESCRIPTION OF THE DRAWINGS

FIG. 4 is a top view of the apparatus vacuum printing box assembly.

FIG. 5 is a side sectional view of the apparatus vacuum printing box assembly as shown in FIG. 4 and seen along the line 5—5 thereof, additionally showing the printing box assembly stencil support in phantom in the tilted ink or paint medium application operational configuration.

DETAILED DESCRIPTION OF THE INVENTION

Figure 1:
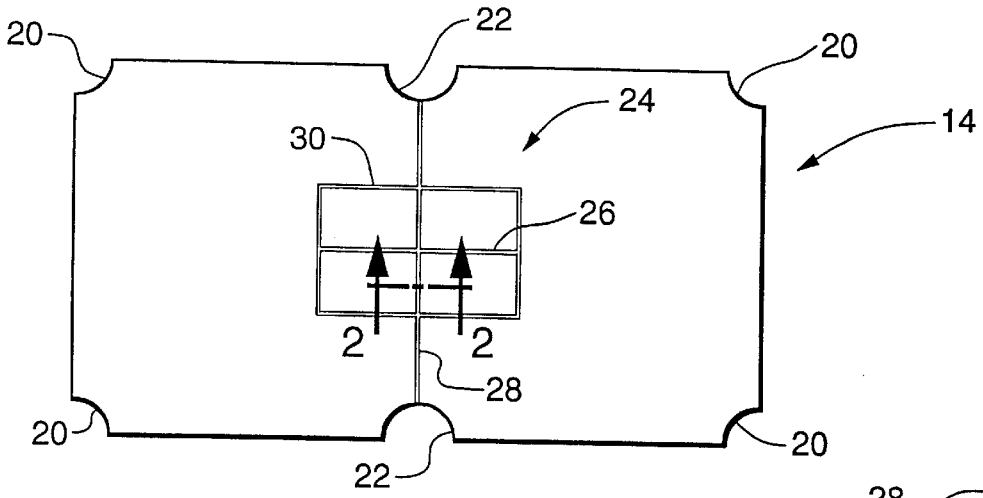
FIG. 1 is a top view of the vacuum printing apparatus pool or billiard table felt cover layout and register template.
Figure 3:
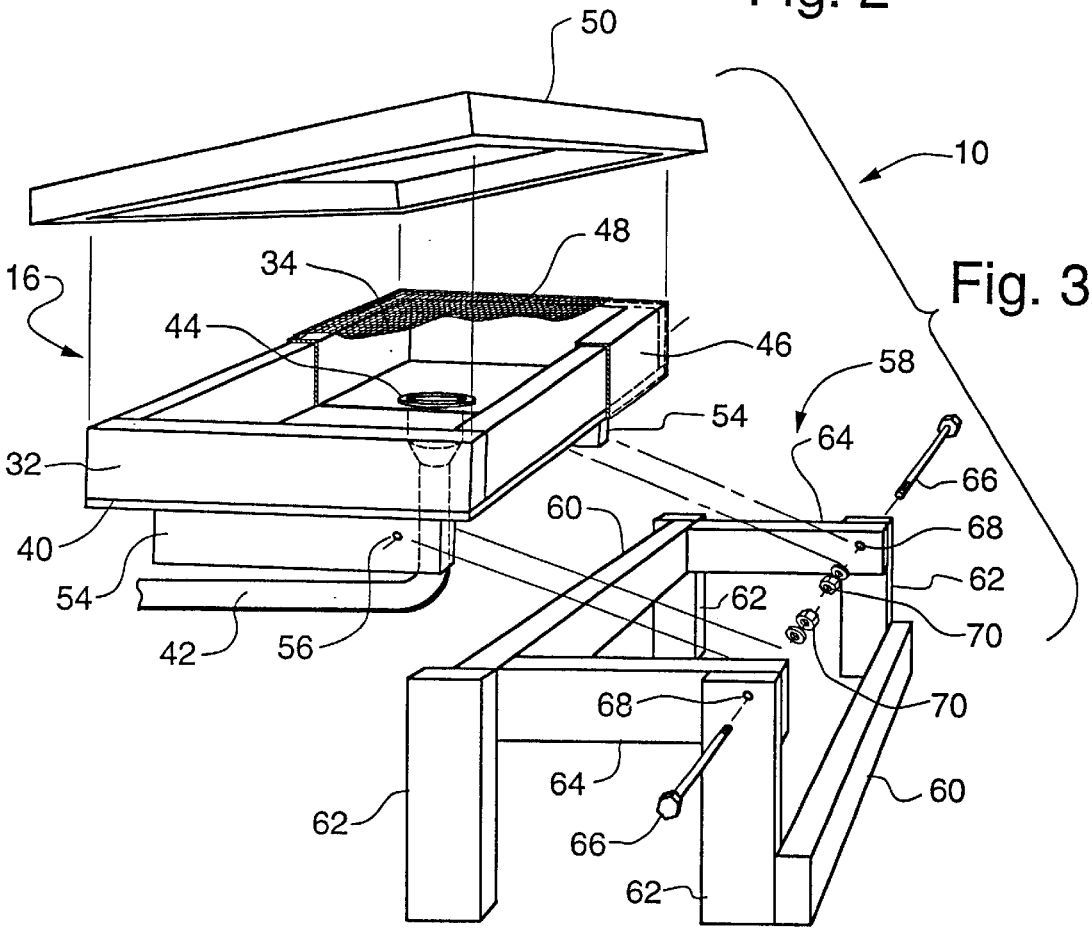
FIG. 3 is an exploded view of the apparatus vacuum printing box assembly.
Figure 6:
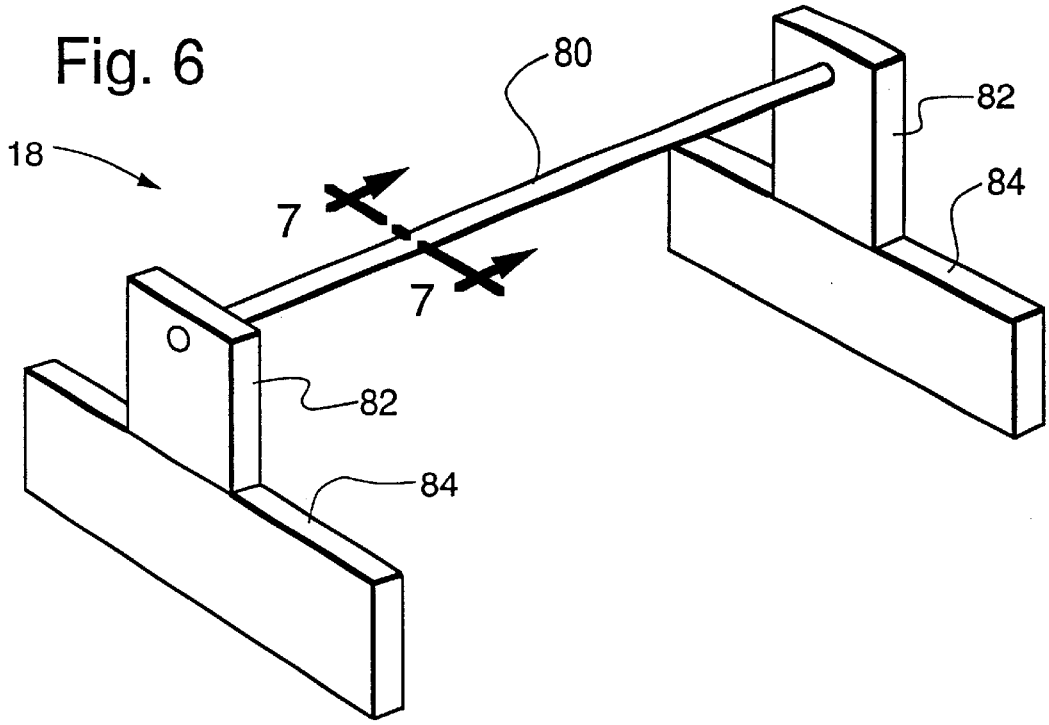
FIG. 6 is a perspective view of the apparatus breakdown rod assembly.

Referring sequentially to FIGS. 1, 3 and 6, wherein the various working components comprising the apparatus for application of decorative imprints 10 to the felt cover playing surface 12 of either a pool or billiard table are respectively illustrated, being first as shown in FIG. 1 the felt cover layout and register template 14, second as shown in FIG. 3 the vacuum printing box assembly 16, and third as shown in FIG. 6 the breakdown rod assembly 18, all of which in combination cooperatively comprise said apparatus for application of decorative imprints 10 by the process method herein taught.

With regard to the foregoing, and in the continued detailed description as hereinafter set forth, it is to be understood that whether a decorative imprint image 36 is to be applied to a pool table or billiard table felt cover playing surface 12, the apparatus 10 and method of practice of the instant teaching are the same and for purposes of convenience and simplicity only, the continuing description and discussion will refer to the apparatus 10 and method as applied to pool table use with the understanding that the same is not to be considered limiting, and likewise applies in every respect to billiard table use.

Figure 2:
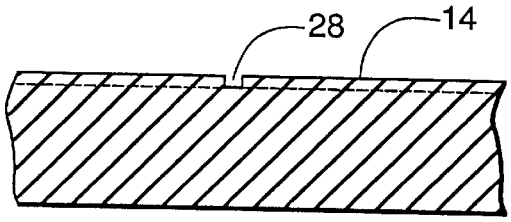
FIG. 2 is an enlarged sectional view of the felt cover layout template register alignment grid as shown in FIG. 1 and seen along the line 2—2 thereof.

Turning attention now to FIGS. 1 and 2 for a more detailed description of the felt cover layout and register template 14, which as shown in FIG. 1 is fabricated from a suitable rigid board material of an adequate thickness such as plywood or the like, being cut in the shape and to the dimensions of a standard sized pool table top, with appropriate recesses for the corner pockets 20 and side pockets 22. Additionally cut within the top surface of the felt cover layout and register template 14 is a felt cover registration grid 24 being comprised of a table top longitudinal dimension dividing center line recess 26, a table top lateral dimension dividing center line recess 28, and a table top centered rectangular shaped vacuum box resister recess 30 all of which accommodates for purposes of make-ready layout the locating of the felt cover playing surface material center to the vacuum printing frame 32 stencil screen 34, which in turn enables registration of the decorative imprint image 36 to the center of the pool table felt cover playing surface material 38 thereby allowing for installation centering of the decorative imprint image 36 to the pool table top when the felt cover playing surface material is applied thereto. And, as will hereinafter be more fully described during consideration of FIGS. 8 through 13, the registration grid also enables the aligned make-ready setup of sequentially printed stencils in the application of multi-color decorative imprints 10.

Figure 8:
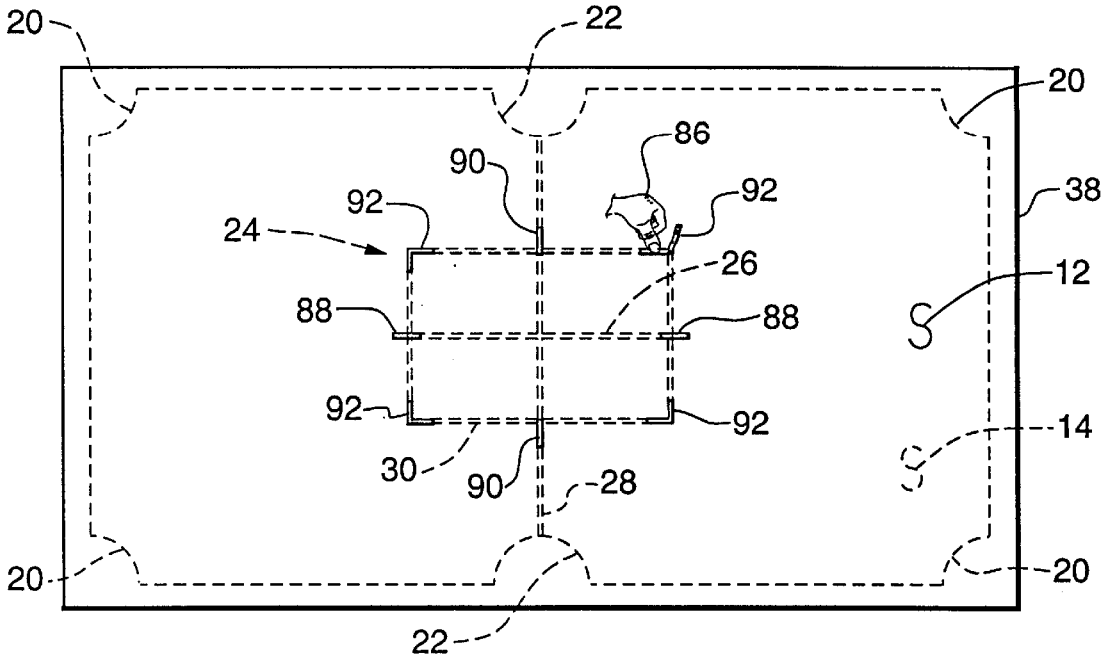
FIG. 8 is a top plan view of the vacuum printing apparatus felt cover layout template showing an exemplary felt cover alignment and application of register tapes.

The illustration shown in FIG. 2 is an enlarged side sectional view of the registration grid 24 lateral dimension dividing center line recess 28 profile, specifically to show that the recesses 26, 28 and 30 of said registration grid 24 provide a means whereby the registration grid 24 can be sensed by finger touch feel through the felt cover playing surface material 38 when it is oriented and laid upon the register template 14 during the make-ready layout procedure for centering a decorative imprint image 36 for printing on the pool table felt cover playing surface 12, wherein the specific lay-out procedure will be discussed in detail on consideration of FIG. 8 as hereinafter more specifically set forth.

Considering next FIG. 3, wherein is shown an exploded view of the apparatus 10 for application of decorative imprints 36. The apparatus 10 is comprised of a vacuum printing box assembly 16 which includes a vacuum printing frame 32 to which is attached a vacuum frame rigid bottom enclosement member 40 adapted to connectably support a vacuum conduit 42 by means of a vacuum conduit connector assembly 44. The vacuum conduit 42 extends from the printing box assembly 16 for connection to a typical vacuum source such as a shop-vac or the like, not shown here but well known in the art, to thereby provide a vacuum differential within the enclosed vacuum printing frame 32. In order to seal the vacuum printing frame 32, a pliable material vacuum frame liner 46 such as sheet rubber or plastic is preferably used and installed around the frame 32 and interiorly across the bottom enclosement member 40 of the vacuum printing box assembly 16. A fine mesh screen 48 is installed over the top of the frame 32 and serves both as a felt material 38 support across the image printing area of the vacuum printing box assembly 16, as well as a porous vacuum backing through which the printing box assembly 16 vacuum differential draws the printing image ink or paint into the felt cover playing surface material 38 fiber structure to impregnate the ink or paint therewithin. Above the screen 48 is a tensioning frame 50 which is provided and adapted to compressively engage and tautly stretch the felt cover playing surface material 38 image printing area in register over the screen 48 surface prepatory to installing the stencil 52. Affixedly installed to the bottom enclosement member 40 at either longitudinal underside end of the vacuum printing frame 32 is a spaced set of vacuum printing frame pivotal support mounts 54, each of which is provided with a frame bolt opening 56 for pivotal bolt engagement assembly to the vacuum printing frame pivot mount 58.

The vacuum printing frame pivot mount 58, also shown in the exploded view perspective of FIG. 3, is preferably constructed of interconnected horizontal and vertical support members 60 and 62 respectively with interconnecting joining beams 64, and serves to pivotally support the vacuum printing box assembly 16 during printing operations as is more clearly illustrated and shown in FIG. 5. Pivot bolts 66, insertably communicating through the respective frame bolt openings 56 of the vacuum printing frame 32 and through the corresponding pivot mount 58 bolt openings 68, serve both as pintles for pivotal angular elevation of the vacuum printing box assembly 16 as well as also by means of compression bolt assemblies 70 to frictionally fix the vacuum printing box assembly 16 in an angular elevated position for printing operations as is likewise shown in FIG. 5.

Turning attention now to FIG. 4, wherein is shown a top view of the vacuum printing box assembly 16, and more particularly showing the tensioning frame 50 grid register marks thereon, being the respective longitudinal center line recess index register marks 72 and the lateral center line recess index register marks 74 which in turn correspond in register alignment respectively to the table top longitudinal dimension dividing center line recess 26 and the table top lateral dimension dividing center line recess 28 as shown upon the felt cover layout and register template 14 illustrated in FIG. 1. It is by means of these corresponding sets of register marks whereby a pool table felt cover playing surface make-ready layout for printing as set up on the register template 14 is transferred and aligned in register for affixment upon the vacuum printing frame 32. It will also be noted that the tensioning frame 50 is further provided with a plurality of offset register alignment marks 76 extending in a regularly repeating incremental pattern either side of each recess index register mark 72 and 74 respectively to provide for register adjustment of a stencil or printed image in the longitudinal or lateral planes as may be necessary or desired.

The view shown in FIG. 5 illustrates the vacuum printing box assembly 16 from a side sectional view, and in phantom shows tilt adjustment and set of the vacuum printing frame 32 in that position generally found to be most convenient for accomplishing printing operations. As shown in the phantom illustration portion of the view, the felt cover playing surface material 38 is stretched in alignment over the screen covered vacuum printing frame 32 and then compressively fixed in taut register by means of peripheral engagement thereof with the tensioning frame 50 being slid down to hold the same in place. The stencil 52 is then fixed in place as will hereinafter be more fully described, afterwhich the printing ink or paint is spray applied through the stencil cut-out by means of an air-brush spray gun 78 employing technique well known in the art, and thereby a decorative imprint image 36 is applied and by means of the operational vacuum differential within the vacuum printing frame 32 the imprint image ink or paint is drawn into the fabric structure of the felt cover playing surface 12. Preferably, the inks or paints that are employed for imparting the decorative imprint image 36 are of the quick drying type so that the felt cover playing surface material 38 may be removed from the vacuum printing frame 32 soon after application thereof for accomplishing the next step of the process method as herein taught.

Figure 7:
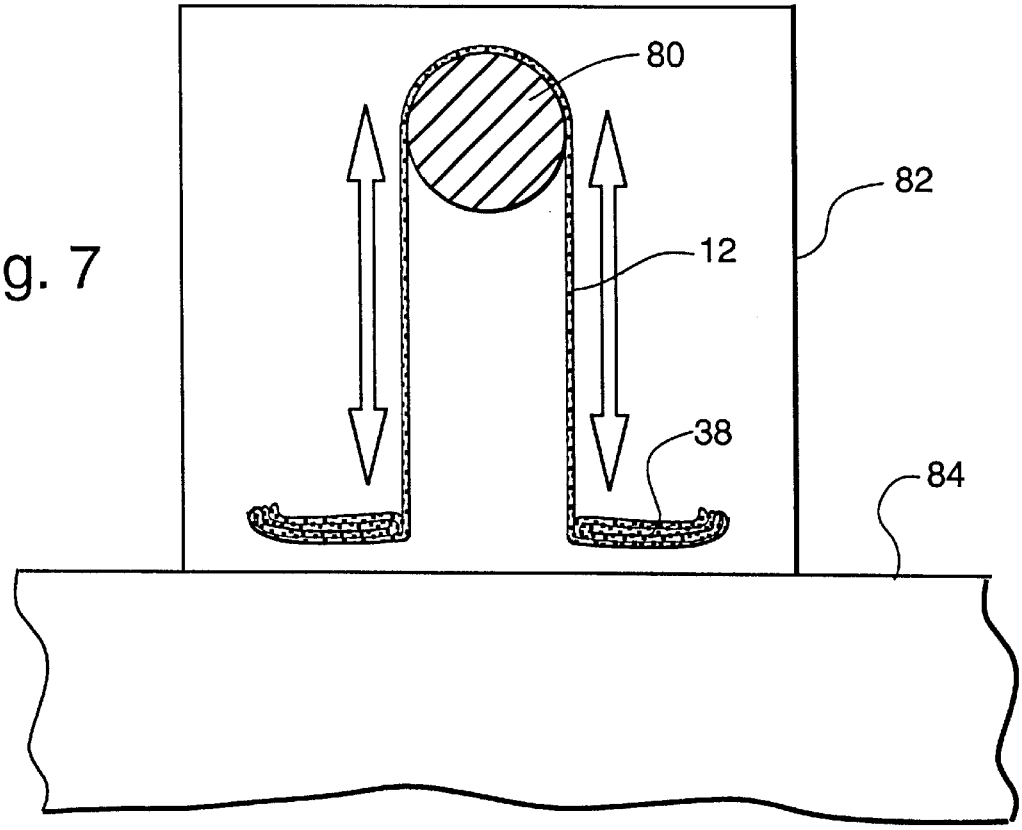
FIG. 7 is an enlarged side sectional view of the apparatus breakdown rod assembly as shown in FIG. 6 and seen along the line 7—7 thereof, with the arrows therein shown indicating the breakdown procedure action.

Considering now the breakdown rod assembly 18 as shown in FIG. 6, which consists of a smooth rod 80 supported horizontally in an elevated position by means of two spaced uprights 82 each of which upright is respectively affixed to a support base 84. Use of the breakdown rod assembly 18 is as illustrated in FIG. 7, wherein the breakdown process consists simply of a taut reciprocative drawing of the decorative imprint image area of the felt cover playing surface 12 back-and-forth across the rod 80 to break down the stiffness of the image impregnated ink or paint within the felt material fabric structure and thereby eliminate any thickness differential in the felt cover playing surface resultant from applied ink or paint in the decorative image imprint area, as well as reinvigorate the porosity of the felt material fabric so that the ink or paint of any subsequently applied colors will likewise be vacuum drawn and impregnated within the felt material fabric structure in a manner similar to that of the first applied or initial color.

In summary, then, the apparatus 10 consists in combination of the felt cover layout and register template 14 with the vacuum printing box assembly 16 and the breakdown rod assembly 18, all of which are cooperatively employed to carry out the process method hereof for accomplishing decorative imprint image application to a pool table felt cover playing surface material without the incorporation therein of any resultant dimensional or thickness irregularity in the playing surface which would otherwise interfere with the course of a ball during play. The various components of the apparatus 10 as above identified are preferably constructed of wood or metal or plastics, or various combinations thereof, by methods and techniques commonly and suitably employed for fabricating such devices.

Turning now to FIG. 8 to consider in greater detail use of the layout and register template 14 in accomplishing make-ready steps to prepare a felt cover playing surface 12 for decorative imprint printing, wherein the template 14 is shown in dashed line rendition centered and underlying the felt cover playing surface material 38, the accomplishment of which centered underlying alignment as above described is the first step in make-ready preparation. Next, the operator, as shown by the operator's hand 86, finger-feels the longitudinal and lateral dimension dividing center line recesses 26 and 28 through the felt cover playing surface material 38 and affixes register tapes 88 and 90 respectively thereon at the edges of the table top centered rectangular shaped vacuum box register recess 30, which register tapes correspond in orientation alignment and dimension to the tensioning frame 50 index register marks 72 and 74 as previously shown in FIG. 4. To further orient and accurize centering location of the felt cover playing surface material to placement upon the vacuum printing frame 32, the operator also finger-feels the intersecting corners of the table top centered rectangular shaped vacuum box register recess 30 and affixes aligned corner marking tapes 92 as also shown, which corner marking tapes 92 correspond in orientation alignment and dimension to the vacuum printing frame 32 corners. With the foregoing register and alignment markings affixed to the felt cover playing surface 12, the felt cover playing surface material 38 is then readied for transfer to and mounting upon the vacuum printing frame 32 in preparation for receiving a stencil 52.

Figure 9:
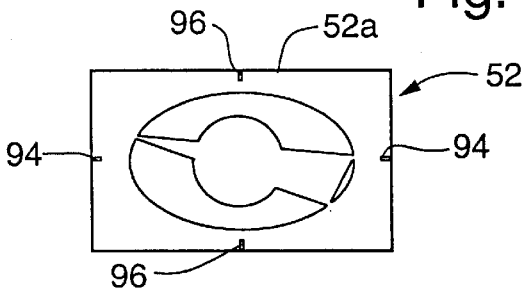
FIGS. 9, 10, and 11 illustrate a series of three-color stencil templates which will result in sequentially successive printed areas as respectively shown in FIGS. 9A, 10A, and 11A in the application of an exemplary multi-color decorative indicia imprint to the felt cover playing surface of a pool or billiard table.
Figure 9A:
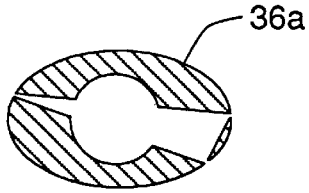
Figure 10:
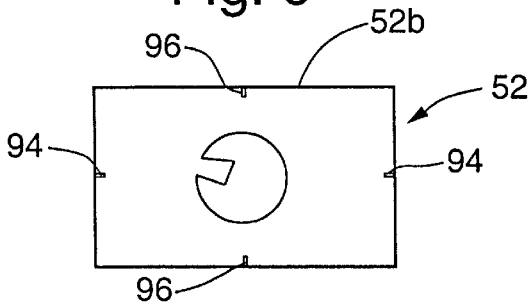
Figure 10A:
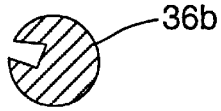
Figure 11:
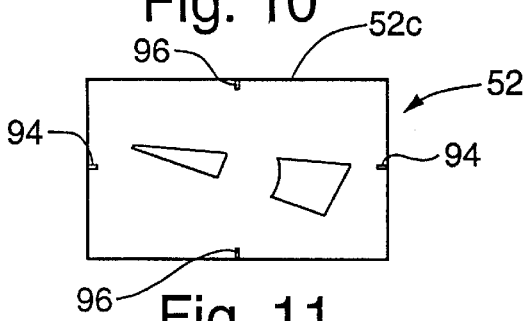
Figure 11A:
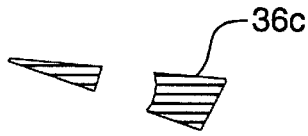

Considering next the series of FIGS. 9 through 11 in conjunction with FIGS. 9A through 11A, which respectively show an exemplary three-color stencil pattern and the corresponding patterns for printing an exemplary decorative imprint image 36 upon the felt cover playing surface material 38. FIG. 9 illustrates the exemplary first color stencil 52*a* with the resultant first color decorative imprint image 36*a* as being shown in FIG. 9A, with FIGS. 10 and 11 respectively illustrating the exemplary second and third color stencils 52*b* and 52*c* and the corresponding resultant second and third color decorative imprint images 36*b* and 36*c* as being respectively shown in FIGS. 10A and 11A. It will be noted that the first color stencil 52*a* as shown in FIG. 9, as well as the second and third color stencils 52*b* and 52*c* as respectively shown in FIGS. 10 and 11, all bear longitudinal and lateral stencil register marks 94 and 96 which correspond in register and dimensional alignment to the longitudinal and lateral register tapes 88 and 90 that were previously placed upon the felt cover playing surface 12 during make-ready. Thus, when the stencil register marks 94 and 96 of the respective color stencils are successively aligned in printing order sequence with the index register marks 72 and 74 on the tensioning frame 50, prepatory to the respective stencil affixments for each color to the vacuum printing frame mounted felt cover playing surface material 38, then the stencil color image for each imprint color will be centered on the felt cover playing surface 12 and successively in register within the printing sequence with the remaining colors of a multi-color decorative imprint image as exemplified by FIGS. 9A through 11A and as shown in completion in FIG. 14.

Figure 12:
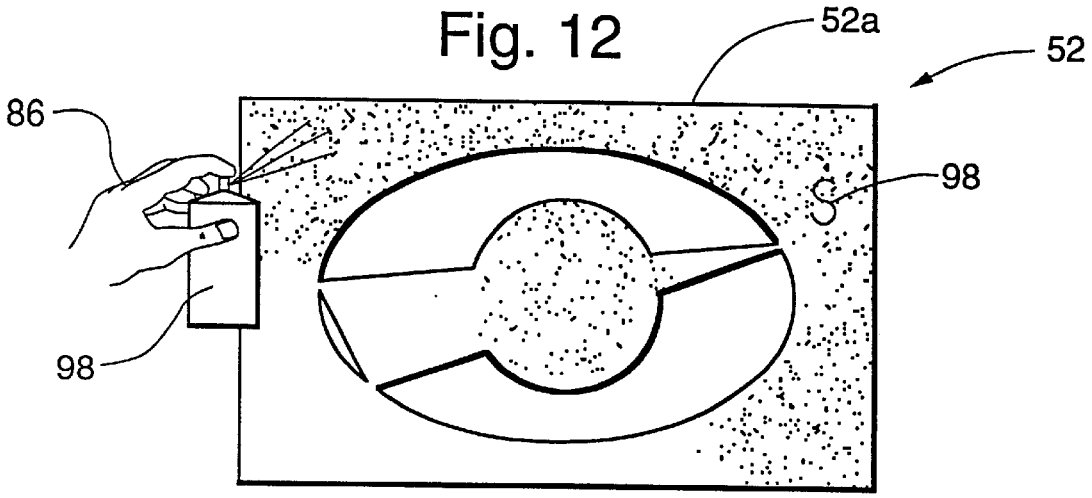
FIG. 12 illustrates the spray application of an aerosol adhesive to the back of an exemplary stencil template.

The view shown in FIG. 12 illustrates application by an operator 86 of a suitable spray adhesive 98 to the underside surface of the first color stencil 52*a,* being exemplary of the manner in which such stencils are prepared for removable adhesion thereof to the vacuum printing frame mounted felt cover playing surface material 38 for purposes of printing. In the case of multi-color image imprinting, after printing impression and removal of the previous stencil, and completion of the breakdown process as previously described, each successive color imprint stencil within the multi-color series is then similarly prepared and adhered in register to the vacuum printing frame re-mounted felt cover playing surface material 38 for subsequent successive color printing of those colors comprising the decorative imprint image 36.

Figure 13:
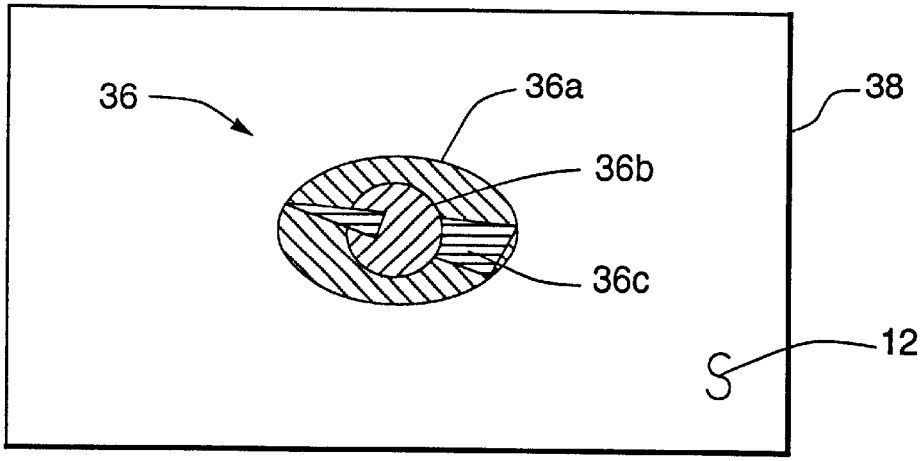
FIG. 13 illustrates the completed exemplary multi-color decorative indicia imprint as the same would appear after application to the felt cover playing surface of a pool or billiard table.
Figure 14:
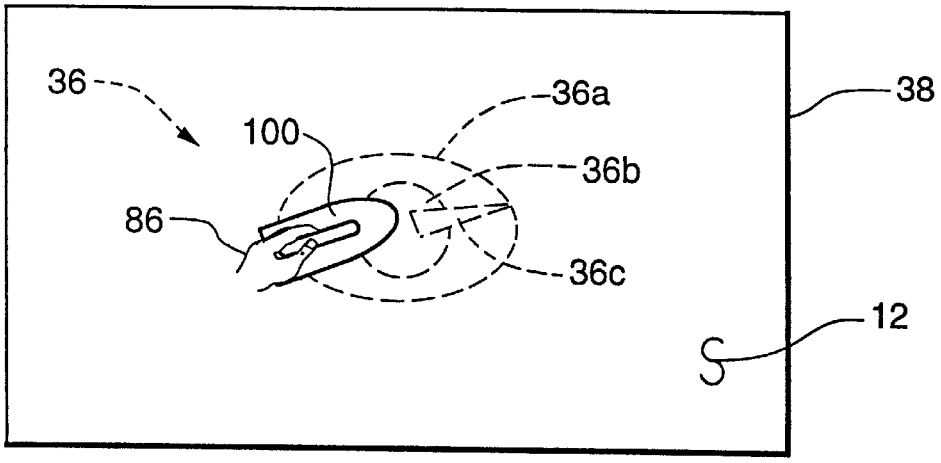
FIG. 14 illustrates the final fixing of the pool or billiard table felt cover playing surface exemplary multi-color decorative indicia imprint as previously shown in FIG. 13.

In FIG. 13 is shown the completed exemplary multi-color decorative imprint image 36, comprised of the successively printed first through third colors as exemplified by 36*a* through 36*c*, as the same would appear in completion upon an exemplary pool table felt cover playing surface 12. The final step in completing the decorative imprint image process method herein taught is to fix the image 36 by means of heat, which is accomplished by an ironing of the image from the non-imprint side of the felt cover playing surface 12 as shown in FIG. 14, for which purpose the operator 86 employs a standard household iron 100 set at a medium heat.

Figure 15:
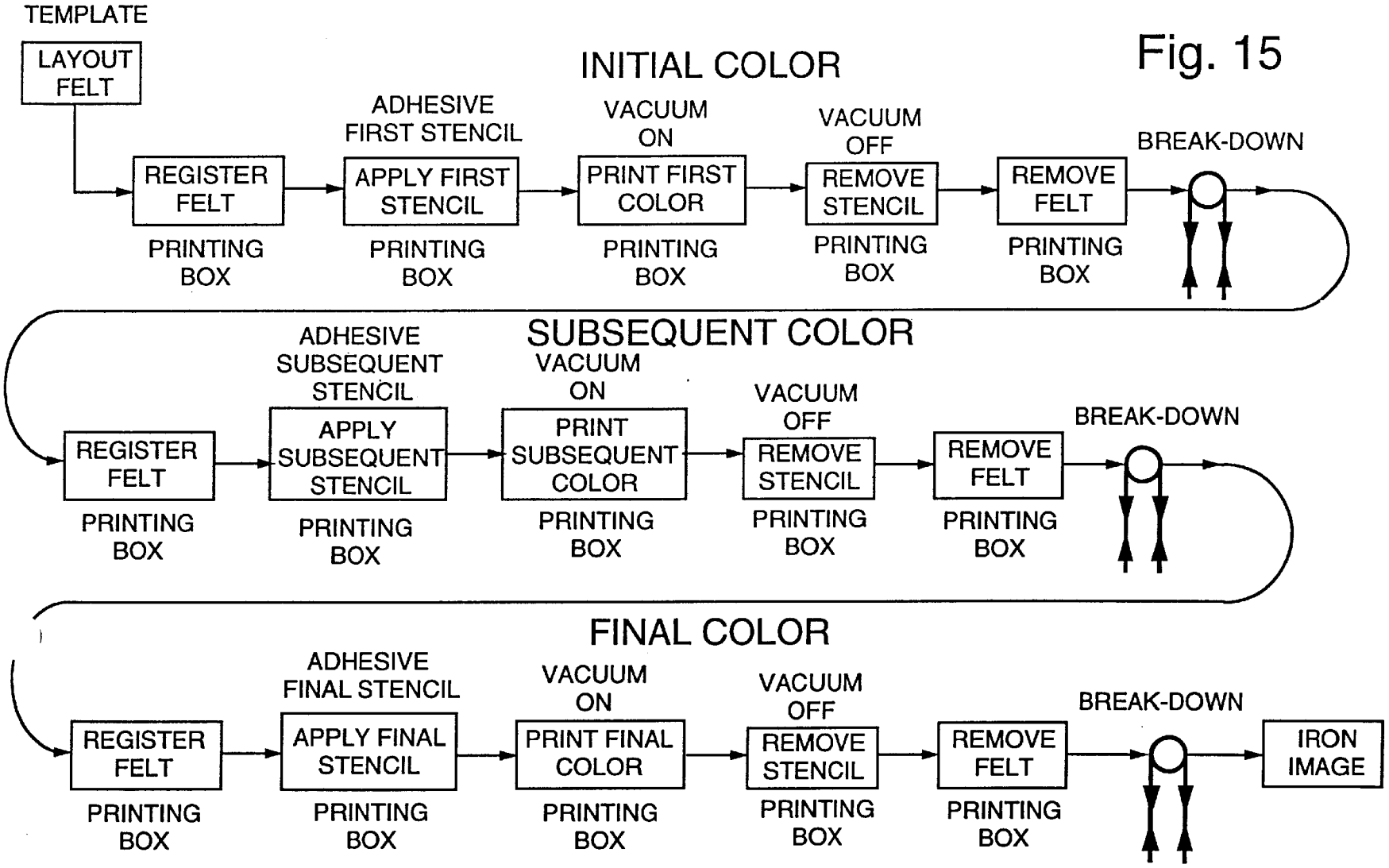
FIG. 15 is a process method flow chart diagram illustrating the sequential steps for accomplishing an exemplary multi-color application of a decorative indicia imprint upon the felt cover playing surface for a pool or billiard table as taught by the invention hereof.

The view shown in FIG. 15 is a flow sheet for the process printing method herein taught, starting at the outset with a layout of the pool table felt for printing by use of the felt cover layout and register template 14 as previously described and shown in FIG. 8. The felt cover with register marks is then taken from the template, assembled in register to the vacuum printing frame 32, and compressively held in place in tautness over the fine mesh stencil screen 48 by means of the tensioning frame 50 as previously described and shown in FIG. 5. Adhesive is then spray applied to the back of the stencil 52 as shown in FIG. 13, and the stencil 52 removably applied in register to the felt cover playing surface material 38 upon the vacuum printing frame. The vacuum is then turned on to draw the stencil 52 and felt cover playing surface material 38 tight to the fine mesh screen 48, the vacuum printing frame 32 is tilted forward and secured in the operational configuration, and the first stencil color is imprinted by use of the air-brush spray gun 78 as also shown in FIG. 5, and by means of the vacuum differential the air-brush ink or paint medium is drawn into and impregnates the felt cover fabric. The vacuum is then turned off and the first color stencil is removed from the felt cover material. When the imprint color ink or paint has dried, the felt cover playing surface material 38 is then removed from the vacuum printing frame 32 and the imprint image is subjected to the break-down process as was previously described and shown in FIG. 7.

The foregoing process method, from felt registration through imprint image break-down is repeated for each subsequently printed color, as well as for the final imprint color, with the last process step being heat fixing of the completed multi-color imprint image by means of a medium heat ironing from the imprint reverse side as was previously described and shown in FIG. 14.

In summary, although the vacuum printing apparatus and process method invention hereof, as well as the structural characteristics and manner of employment thereof for accomplishing an imprint in either single or multi-color renditions upon the felt cover playing surface of a pool table have been shown and described in what are conceived to be the most practical and preferred versions, it is recognized that departures may be made respectively therefrom within the scope of the invention, which is not to be limited per se to those specific details as described herein but is to be accorded the full scope of the claims so as to embrace any and all equivalent such devices, apparatus, and methods.

I claim:

1. A vacuum printing apparatus, said apparatus comprising in combination a means for accomplishing layout and register of a decorative imprint to a game table felt cover playing surface material, a vacuum printing box assembly to support the game table felt cover playing surface material and a stencil thereon for accomplishing a decorative imprint transfer to the game table felt cover playing surface material, an air-brush spray gun to apply a color medium to said stencil, a breakdown means to reduce any dimensional irregularities in the game table felt cover playing surface material resultant from the decorative imprint transfer thereto, and a heat means to fix the decorative imprint transfer to the game table felt cover playing surface material.

2. A vacuum printing apparatus according to claim 1 in which the decorative imprint is a single color imprint.

3. A vacuum printing apparatus according to claim 2 in which the color medium for the decorative imprint is an ink.

4. A vacuum printing apparatus according to claim 2 in which the color medium for the decorative imprint is a paint.

5. A vacuum printing apparatus according to claim 1 in which the decorative imprint is a multi-color ink imprint.

6. A vacuum printing apparatus according to claim 1 in which the decorative imprint is a multi-color paint imprint.

7. A vacuum printing apparatus according to claim 1 in which the game table felt cover playing surface material covers a pool table.

8. A vacuum printing apparatus according to claim 1 in which the game table felt cover playing surface material covers a billiard table.

9. A vacuum printing apparatus according to claim 1 in which said means for accomplishing layout and register of the decorative imprint to the game table felt cover playing surface material is a layout and register template.

10. A vacuum printing apparatus according to claim 1 in which said printing box assembly is provided with a vacuum printing frame having an enclosement bottom to support a vacuum conduit connection.

11. A vacuum printing apparatus according to claim 10 in which said vacuum printing frame having said enclosement bottom is sealably lined with a pliable material.

12. A vacuum printing apparatus according to claim 11 in which said vacuum printing frame having said enclosement bottom has the upward facing open side thereof covered with a fine mesh screen.

13. A vacuum printing apparatus according to claim 10 in which said vacuum printing frame is provided with a tensioning frame.

14. A vacuum printing apparatus according to claim 10 in which said vacuum conduit connection supports a vacuum conduit communicating to a vacuum source.

15. A vacuum printing apparatus according to claim 10 in which said vacuum printing box assembly is provided with an angular adjustment means.

16. A vacuum printing apparatus according to claim 15 in which said angular adjustment means is comprised of a vacuum printing frame pivot mount in combination with a set of compression bolt assemblies.

17. A vacuum printing apparatus according to claim 1 in which said breakdown means is comprised of a horizontally disposed smooth rod upwardly supported by a set of spaced uprights.

18. A vacuum printing apparatus according to claim 1 in which said heat means is a household iron.

19. A vacuum printing process method for application of a decorative imprint to a felt cover playing surface material for a game table, said method comprising performing by means of a template a registration layout of said felt cover playing surface material for receiving a decorative imprint stencil, assembling said felt cover playing surface material in registered orientation to a vacuum printing frame, spray applying an adhesive to the back of said decorative imprint stencil and affixing said stencil in register to said felt cover playing surface material assembled to said vacuum printing frame, activating a vacuum source connected to said vacuum printing frame, spray applying a color medium to said stencil to effect a color transfer of said decorative imprint to said felt cover playing surface material, vacuum impregnating said color medium within the fabric structure of said felt cover playing surface material, deactivating said vacuum source and removing said stencil from said felt cover playing surface material, removing said felt cover playing surface material from said vacuum printing frame, reinvigorating the felt fabric structure of said felt cover playing surface material in the decorative imprint image area by subjecting the same to a breakdown process, and fixing the decorative imprint to said felt cover playing surface material by subjecting the same to a heat source.

* * * * *